US006839644B1

(12) United States Patent
Woods et al.

(10) Patent No.: US 6,839,644 B1
(45) Date of Patent: Jan. 4, 2005

(54) PLUMBING SUPPLY MONITORING, MODELING AND SIZING SYSTEM AND METHOD

(75) Inventors: Paul K. Woods, Kurten, TX (US); John A. Bryant, College Station, TX (US); Kenneth B. Parker, Houston, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/405,074

(22) Filed: Mar. 31, 2003

Related U.S. Application Data

(60) Provisional application No. 60/369,356, filed on Apr. 1, 2002.

(51) Int. Cl.[7] ..... G06F 19/00
(52) U.S. Cl. ..... 702/56; 702/54
(58) Field of Search ..... 73/1.48, 1.82; 702/33, 39, 45, 48, 50, 54, 56, 179, 182, 183

(56) References Cited

U.S. PATENT DOCUMENTS 5,829,467 A * 11/1998 Spicher ..... 137/14
6,236,953 B1 * 5/2001 Segal ..... 702/127
6,250,601 B1 * 6/2001 Kolar et al. ..... 251/129.04
6,301,973 B1 * 10/2001 Smith ..... 73/861.357
6,336,233 B1 * 1/2002 Shaw et al. ..... 4/664
6,601,005 B1 * 7/2003 Eryurek et al. ..... 702/104
2002/0019709 A1 * 2/2002 Segal ..... 702/45
2002/0073768 A1 * 6/2002 Joynes ..... 73/40.5 A

* cited by examiner

*Primary Examiner*—John Barlow
*Assistant Examiner*—Douglas N Washburn
(74) *Attorney, Agent, or Firm*—Baker Botts L.L.P.

(57) ABSTRACT

A system for monitoring a plumbing system having a plurality of fixtures includes a sensor vibrationally coupled to the plumbing system and a processor. The sensor detects a vibration produced by the plumbing system, and generates a signal representative of the vibration. The processor receives the signal, compares the signal to a signal database that associates each of a plurality of stored signals with operation of one or more of the fixtures, and determines that the associated fixture or group of fixtures has been operated based on the comparison. The processor also stores a record of the operation of the associated fixture or group of fixtures.

17 Claims, 2 Drawing Sheets

PLUMBING SUPPLY MONITORING, MODELING AND SIZING SYSTEM AND METHOD

RELATED APPLICATIONS

This application claims the priority benefit of U.S. Provisional Application Ser. No. 60/369,356 filed Apr. 1, 2002.

TECHNICAL FIELD OF THE INVENTION

This invention relates in general to the field of plumbing systems and, more particularly, to a plumbing supply monitoring, modeling and sizing system and method.

BACKGROUND OF THE INVENTION

Having an accurate determination of the amount of fixture usage in a plumbing system may be useful for a variety of reasons. The level of usage may help to predict the amount of associated resources, such as water supply or paper products, used in conjunction with the fixtures. It may also be used to assess the amount of wear on components of a plumbing system and to determine when components need to be replaced. Such information may also be used to redesign or improve the plumbing system in order for the system to function more effectively. For these reasons and many others, it is useful to have a method for determining the amount of plumbing fixture usage.

One method for monitoring restroom plumbing fixture use may include a camera mounted in the restroom. However, this has obvious social drawbacks. A person could monitor facility use, but in additional to social drawbacks, the person could not monitor continuously for 24 hours per day. Sensors (magnetic relay or optical relay) could be mounted in some fashion at each fixture, but this would require extensive wiring that is difficult to perform and/or install in existing facilities.

Flow meters could be installed in the supply lines for each of the fixture groups (water closet, urinal, lavatory), but this may be a prohibitively expensive and difficult option. Access to the piping supply risers is typically very limited, the cost per fixture group would be significant, and such metering would require shutdown of the facility for installation and removal of the flow meters.

SUMMARY OF THE INVENTION

The present invention provides a method and system for monitoring a plumbing system using a monitoring system vibrationally coupled to the plumbing system. Particular embodiments of the present invention provide a passive, non-invasive, opaque-to-facility-users, portable, and low-cost system and method for monitoring, modeling and sizing plumbing systems. Such embodiments present considerable advantages over existing techniques for monitoring plumbing systems.

In a particular embodiment, a system for monitoring a plumbing system having a plurality of fixtures includes a sensor vibrationally coupled to the plumbing system and a processor. The sensor detects a vibration produced by the plumbing system, and generates a signal representative of the vibration. The processor receives the signal, compares the signal to a signal database that associates each of a plurality of stored signals with operation of one or more of the fixtures, and determines that the associated fixture or group of fixtures has been operated based on the comparison. The processor also stores a record of the operation of the associated fixture or group of fixtures.

In another embodiment, a method for monitoring a plumbing system having a plurality of fixtures includes detecting, by a sensor, a vibration produced by a plumbing system, and generating, by the sensor, a signal representative of the vibration. The method further includes comparing, by a processor, the signal to a signal database that associates each of a plurality of stored signals with operation of one or more of the fixtures. The method also includes determining that the associated fixture or group of fixtures has been operated based on the comparison, and storing a record of the operation of the associated fixture or group of fixtures.

Important technical advantages of certain embodiments of the present invention include a non-invasive method for monitoring a plumbing system. Certain embodiments of the monitoring system may couple to accessible locations of a plumbing system, such as supply lines, valves, and fittings. This permits the use of the system without requiring complicated installation procedures. Particular embodiments may be compact and portable as well, further increasing their versatility.

Other important technical advantages include the use of "off the shelf" components in a monitoring system. Particular embodiments use conventional technology, such as microphones, personal computers, and existing voice recognition software, which is adapted for use in conjunction with a plumbing system. This permits production of monitoring systems without requiring specialized components that may be expensive and difficult to install.

Still other important technical advantages of certain embodiments of the present invention include concealability. Particular embodiments may be placed in areas inaccessible by users of fixtures of the monitored plumbing system. This prevents unnecessary social embarrassment that may be associated with being monitored, and it also protects the monitoring equipment from vandalism.

Although certain technical advantages have been enumerated here, particular embodiments of the present invention may include some, none, or all of the enumerated technical advantages. Other technical be readily apparent to those skilled in the FIGURES, descriptions, and claims

BRIEF DESCRIPTION OF THE DRAWINGS

For a more complete understanding of the present invention and its advantages, reference is now made to the following description, taken in conjunction with the accompanying drawings, in which.

DETAILED DESCRIPTION OF THE INVENTION

Figure 1:
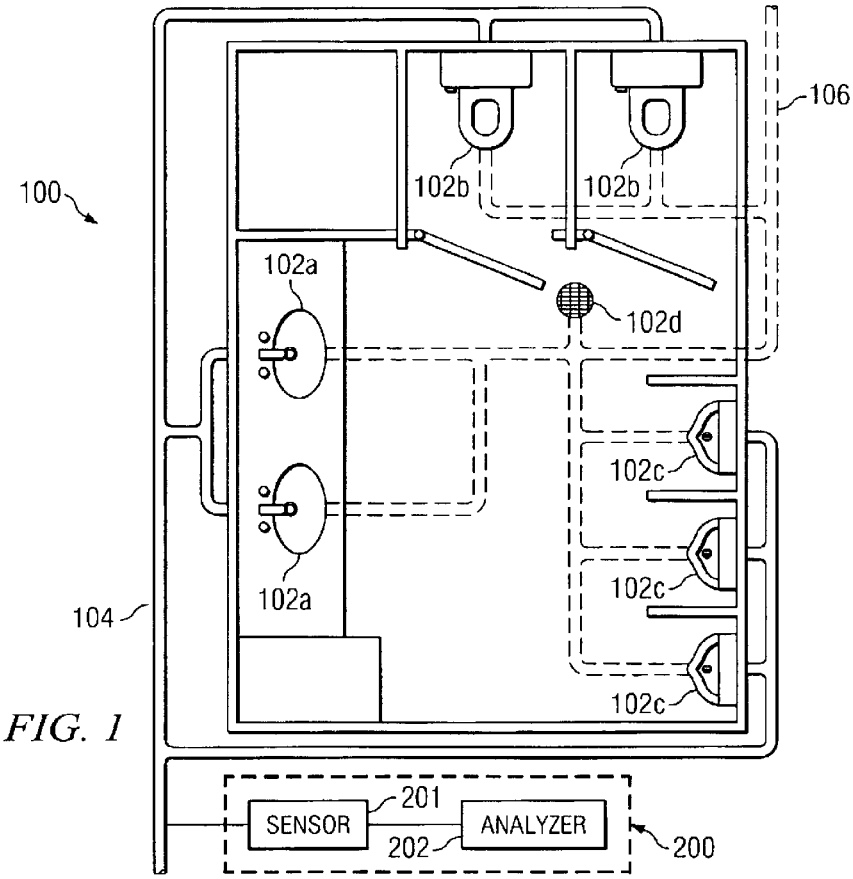
FIG. 1 shows a monitoring system, according to a particular embodiment of the present invention, coupled to a plumbing system.

FIG. 1 shows a plumbing system 100 that provides water services to a plurality of fixtures 102 (referring generally to fixtures 102*a*, 102*b*, 102*c*, and 102*d*). Supply lines 104 provide water or other fluid to fixtures 102, while drain lines 106 remove waste water or fluid from fixtures 102. Monitoring system 200 is vibrationally coupled to plumbing system 100. In general, monitoring system 200 detects vibrations produced by the operation of one or more fixtures 102 and determines that the detected vibration corresponds to the operation of the one or more fixtures 102 that generated the vibration.

Fixtures 102 represent any components of plumbing system 100 that use water from plumbing system 100 or provide waste water to plumbing system 100 for disposal. In the depicted embodiment, fixtures 102 include lavatories 102*a*, water closets 102*b*, urinals 102*c*, and a floor drain 102*d*. Those components, however, are only examples, and plumbing system 100 may include other fixtures 102, including faucets, drains, showers, baths, or other suitable devices. Fixtures 102 may be operated by users in any manner suitable to the type of fixture 102, such as opening a flush valve or lavatory valve.

Supply lines 104 and drain lines 106 represent any suitable collection of pipes, valves, fittings, junctions, gaskets, sealers, or other components for carrying water to fixtures 102 or draining water away from fixtures 102. Pipes used in plumbing system 100 may be made from metal, plastic, or other suitable materials. Plumbing system 100 may also include filtration devices, purifiers, disposals, or other devices coupled to supply lines 104 and drain lines 106. Various components of plumbing system 100 may operate at any suitable water pressure.

Monitoring system 200 monitors vibration produced in plumbing system 100 by the operation of fixtures 102. The vibrations sensed by monitoring system 200 are routinely generated due to turbulence in a fluid as it flows through valves, fittings and other turbulence-inducing objects, usually in association with a piping or plumbing system. One application of this process may be used to monitor plumbing fixtures used in restroom facilities. However, other plumbing uses may also be monitored with the scope of the invention. Although monitoring system 200 is shown as being coupled to a particular location in plumbing system 100, monitoring system 200 may be coupled to plumbing system 100 at any suitable location on supply lines 104, drains lines 106, fixtures 102, or any other area that permits detection of vibrations produced by fixtures 102. For reasons stated earlier, it is generally desirable to conceal monitoring system 100 from users of fixtures 102 to prevent embarrassment and to protect monitoring system 200 from vandalism.

In the depicted embodiment, monitoring system 200 includes a sensor 201 and an analyzer 202. Sensor 201 is any suitable component that detects any manner of vibration in plumbing system 100 and generates a signal that represents the detected vibration. Examples of sensors 201 include microphones, accelerometers, transducers, pressure sensors, laser devices, or other suitable components for detecting vibration. The type of sensor 201 may be selected based on cost, sensitivity, accuracy, or any other suitable design consideration. Sensor 201 may be coupled to plumbing system 100, either proximal to an element of system 100 or placed some distance away, either in sufficient proximity to detect vibrations or coupled to system 100 by a vibrational connection suitable for carrying vibrations to sensor 201, such as a stethoscope.

Analyzer 202 analyzes the signals produced by sensors 201 in order to learn characteristic vibrational patterns produced by fixtures 102 in operation ("vibrational signatures") and to compare received signals to previously stored vibrational signatures to determine when a particular fixture 102 or group of fixtures 102 is operating. Analyzer 202 is coupled to sensor 201 using any suitable wireline or wireless connection for communicating signals generated by sensor 201 to analyzer 202. Analyzer 202 may perform any suitable conversion or processing, such as converting analog output from sensor 201 to digital form, in order to perform this analysis. In a particular embodiment, analyzer 202 uses voice recognition software to learn the vibrational signatures of fixtures 102 and to identify the vibrational signatures when they are detected later.

Monitoring system 200 has two modes of operation: a learning mode and a recognition mode. In learning mode, monitoring system 200 is coupled to plumbing system 100 and monitors vibrations produced by the plumbing system 100. Using pattern recognition techniques, monitoring system 100 identifies particular vibrational patterns that are distinctive and stores those patterns in memory. Over time, monitoring system 100 builds a database of signals associated with the vibrational signatures of fixtures 102. These signatures can then be associated with physical devices by input from a user. For example, the user may operate a fixture 102, check to see which vibrational signature is recognized, and program monitoring system 200 to associate the vibrational signature with the physical device.

Once monitoring system 100 has adequately learned the vibrational signatures of fixtures 102, monitoring system 100 may begin to operate in recognition mode. In recognition mode, monitoring system 100 monitors for signals matching any stored signals, and when a matching signal is detected, monitoring system 100 records a fixture-operation event. The record of the fixture-operation event may include a date, time, and an identifier for the particular fixture 102 or group of fixtures 102 operated. As more records are stored, the usage patterns of fixtures 102 may be statistically analyzed. In conjunction with other information, such as the amount of water used by particular fixtures 102 and the overall design of plumbing system 100, the records may be used to determine total water usage over a certain time period, maximum water usage, average water usage, instantaneous flow velocities at a particular point in plumbing system 100, or a wide array of other useful pieces of information.

Although monitoring system 100 has been depicted with a single sensor 201 and analyzer 202, monitoring system 100 may include multiple sensors 201 and/or analyzers 202, operating independently or under common control. In addition, a single sensor 201 may be used to monitor a single plumbing activity or event, or a single sensor 201 may be used to monitor multiple plumbing components and events. Sensors 201 may be distributed among multiple locations in plumbing system 100 to monitor different components or to provide redundancy to verify the accuracy of detected events. When multiple sensors 201 are coupled to a single analyzer 202, a mixing device may be used to process the signals received from each sensor 201 separately.

Some advantages of this invention over other methods that might be used for similar purposes may include cost, ease of installation, opacity to facility users, and portability. In one embodiment, the described monitoring system 200 presents advantages over existing methods because it can be passive—requiring no moving parts typical of in-line flow meters; it can be non-invasive requiring neither intrusion into the privacy of a restroom like an on-site monitor nor insertion into the piping system like a flow meter; it can be opaque to users—facility users need not see or hear system 200 when it is in operation like an observation camera or an on-site observer; it can be portable—system 200 may be transported by one person unlike data loggers or video cameras and recorders; and it can be low cost—the initial costs and operating costs may be much lower for system 200 than video monitoring systems, flow metering systems or on-site observers.

The data on plumbing fixture use may be used to reevaluate piping system design criteria and possibly influence restroom design. In certain embodiments of monitoring system 200, continuous monitoring is also possible for water use or conservation studies. Furthermore, certain embodiments of the described monitoring system 200 may solve many problems associated with existing methods. In a non-limiting list of examples of such embodiments, certain embodiments may require less maintenance than flow metering systems; they may be installed and removed without a large amount of ancillary damage to a building; they may be used so as not to intrude on the privacy of restroom users; they may be durable, small and easily carried from one project to another; and they may have lower initial installation and maintenance costs as compared to existing systems.

The described techniques are not limited in application to plumbing systems. In principle, they may be adapted to any mechanical system that involves vibrational signatures for the operation of a particular component or group of components of the system. In one non-limiting example, monitoring system 200 may be adapted to monitor an automobile engine to detect problems that are associated with a particular vibration. In another example, monitoring system 200 could monitor a construction site for characteristic vibrations, such as firing an air gun, to monitor various stages of the construction process. Manufacture of certain articles or materials may be monitored for characteristic vibrations produced at various stages in the formation process, such as the vibrations produced by concrete in different stages of hardening. Thus, the described monitoring system 200 may be adaptable to a wide array of other mechanical systems.

Figure 2:
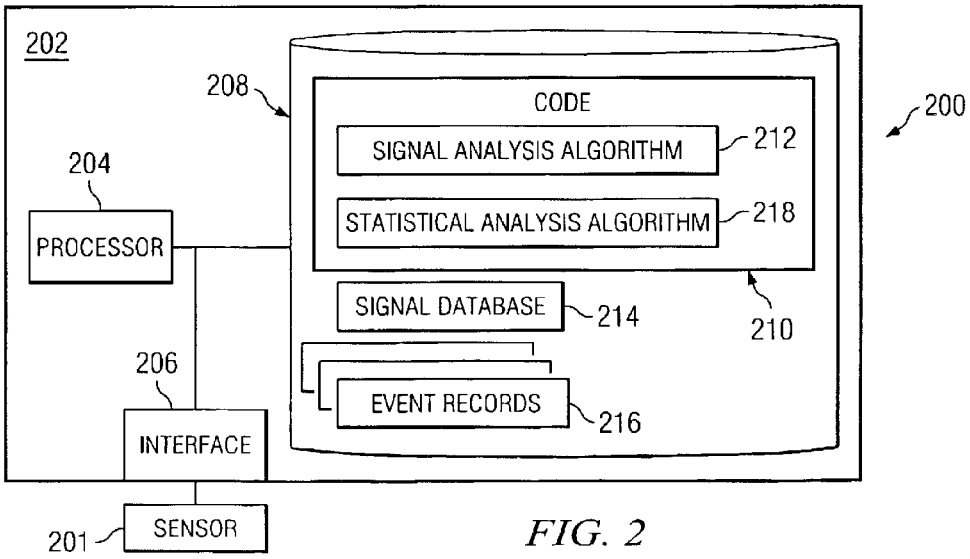
FIG. 2 illustrates a particular embodiment of the monitoring system of FIG. 1.

FIG. 2 shows a particular embodiment of monitoring system 200. In the depicted embodiment, analyzer 202 includes a processor 204, an interface 206, and a memory 208. Processor 204 represents any suitable hardware and/or software for processing information and performing any suitable task of analyzer 202. Processor 204 may include microprocessors, micro-controllers, digital signal processors (DSPs), or any other suitable component or components. Interface 206 represents any port or connection, whether real or virtual, that enables analyzer 202 to communicate with components of monitoring system 200. In particular, interface 206 allows analyzer 202 to receive signals from sensor 201, performing any suitable signal conversion, mixing, or other processing to convert received signals into a form suitable for use by analyzer 202. Memory 208 represents any suitable form of information storage, whether volatile or non-volatile, and memory 208 may include magnetic media, optical media, removable media, local components, remote components, or any other information storage accessible by processor 204. Memory 208 stores code 210 executed by processor 204 to perform various tasks of analyzer 202, as described in greater detail below.

In a learning mode of operation, analyzer 202 uses a signal analysis algorithm 212 within code 210 operable to detect characteristic patterns in vibrations detected by sensor 201. Examples of signal analysis algorithms 212 include commercially available voice recognition software, such as VoicePlus from HK Software, or custom software programs. Recognizable patterns are stored in a signal database 214 for later comparison in recognition mode. Analyzer 202 may also be programmed to associate recognizable signals with particular fixtures 102 or groups of fixtures 102.

Once a reasonably complete signal database 214 has been assembled, analyzer 202 may operate in recognition mode. In recognition mode, analyzer 202 uses signal analysis algorithm 212 to compare a received signal to signals stored in database 214 and based on the comparison, analyzer 202 identifies any stored signal that matches the received signal. If a match is detected, analyzer 202 determines that the associated fixture 102 or group of fixtures 102 has been operated, and stores a record 216, which may include the date and time of the fixture-operation event. Analyzer 202 may store records 216 in any suitable format and may include any suitable information. For example, analyzer 202 may store events in a Microsoft Word document, using a macro to automatically include a date- and timestamp in record 216.

Analyzer 202 uses statistical analysis algorithm 218 to analyze records 216 for the purpose of extrapolating useful information from them. Statistical analysis algorithm 218 may be any suitable well-known statistical analysis routine or yet-to-be-developed routine. Analyzer 202 may take into account any additional information, such as known properties of fixtures 102 or configuration of plumbing system 100, to present the resulting information in a useful form. For example, analyzing patterns in the use of fixtures 102 may be used to extrapolate quantities such as total water use, average water use, and maximum water use. This information may in turn be used to assist in modeling, sizing, or modifying plumbing system 100.

Figure 3:
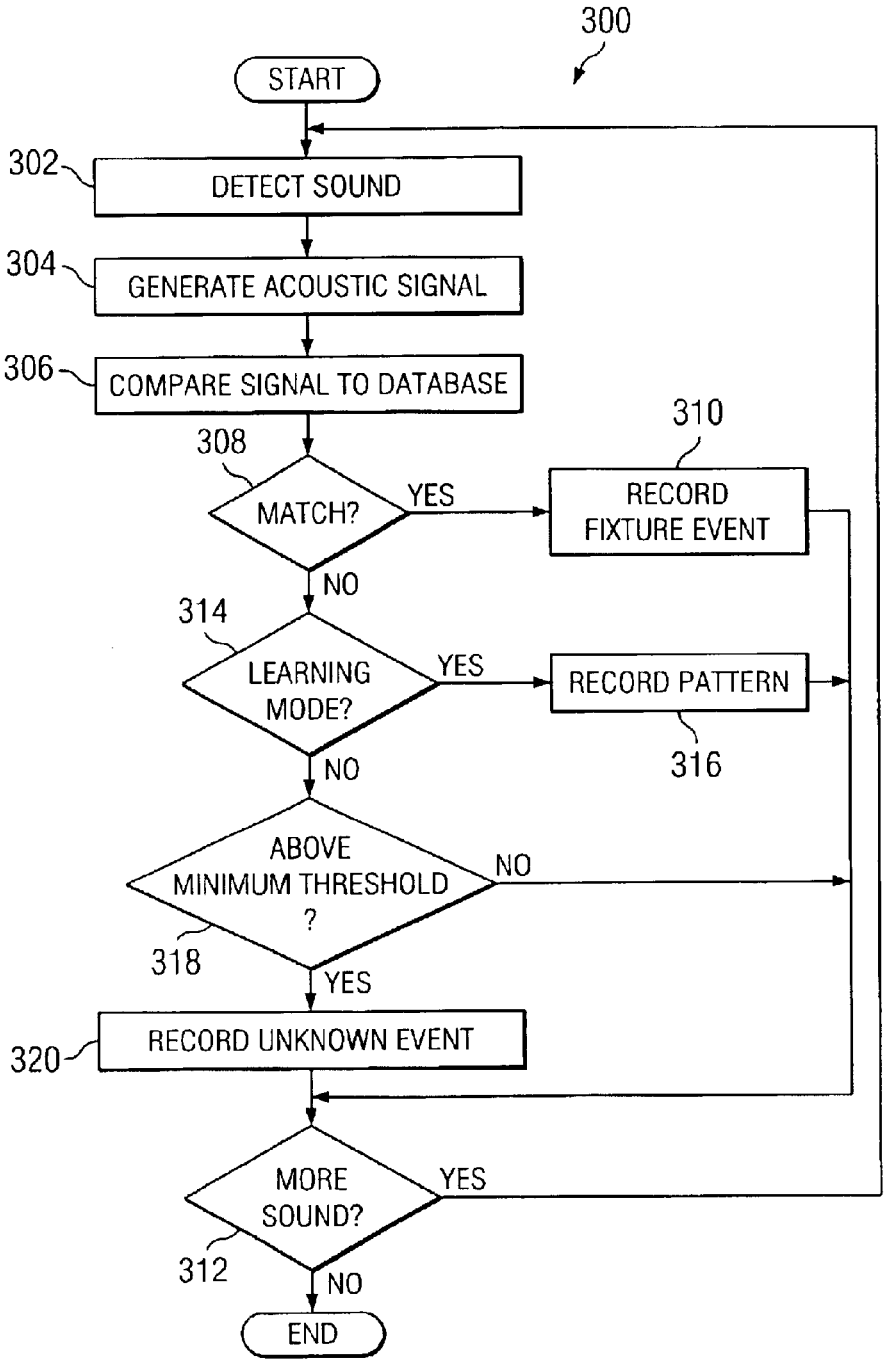
FIG. 3 is a flow chart showing an example of a method of operation for the monitoring system of FIG. 1.

FIG. 3 is a flow chart showing one example of a method of operation for monitoring system 200. Sensor 201 detects a vibration produced by plumbing system 100 at step 302, and generates a signal representative of the vibration at step 304. Analyzer 202 compares this signal to signal database 214 at step 306. Based on the comparison, analyzer 202 determines whether the signal matches a stored signal in database 214 at step 308.

If the signal matches a stored signal, monitoring system 200 records the event at step 310. How the event is recorded may depend on the mode in which monitoring system 200 is operating. If monitoring system 200 is operating in learning mode, monitoring system 200 may store the pattern of the signal in database 214 as part of the process of learning the vibrational signatures of various fixtures 102. If monitoring system 200 is operating in recognition mode, then system 200 may store a record that specifies useful information about the event, such as which fixture 102 operated and the time of operation (such as date, time, or duration).

If the signal received from sensor 201 does not match a stored signal in database 214, then the response of analyzer 202 depends on whether system 200 is in learning mode or recognition mode, as shown by decision step 314. If system 200 is in learning mode, analyzer 202 may record the pattern of the signal in order to more fully develop its catalog of known vibrational patterns. On the other hand, if system 200 is in recognition mode and comes across an unrecognized signal, it may determine whether the signal is significant according to a significance threshold, which is a predetermined set of criteria, such as minimum volume or minimum duration, that may be used to determine whether an unknown signal represents a significant event in plumbing system 100. If the signal is determined to be significant, analyzer 202 may record the event as an event of unknown type, including any suitable time information such as date, time, or duration. In addition, analyzer 202 may store a pattern for the signal to assist in future learning.

Once the event has been classified as recognizable or not and any suitable record has been made, system 200 determines whether sensor 201 is continuing to receive vibrations. If sensor 201 is continuing to receive vibrations, the method repeats from step 302. Otherwise, the method is at an end.

Although the present invention has been described in detail, various changes and modifications may be suggested to one skilled in the art. It is intended that the present invention encompass such changes and modifications as falling within the scope of the appended claims.

What is claimed is:

1. A system for monitoring a plumbing system having a plurality of fixtures, comprising:

a microphone vibrationally coupled proximal to a supply line of the plumbing system, the microphone operable to:

detect a vibration produced by the plumbing system; and generate a signal representative of the vibration; and a processor operable to:

receive the signal;

compare the signal to a signal database, the signal database associating each of a plurality of stored signals with operation of one or more of the fixtures;

determine that the associated one or more fixtures have been operated based on the comparison; and store a record of the operation of the associated one or more fixtures.

2. A system for monitoring a plumbing system having a plurality of fixtures, comprising:

a sensor vibrationally coupled to the plumbing system, the sensor operable to:

detect a vibration produced by the plumbing system; and generate a signal representative of the vibration; and a processor operable to:

receive the signal;

compare the signal to a signal database, the signal database associating each of a plurality of stored signals with operation of one or more of the fixtures;

determine that the associated one or more fixtures have been operated based on the comparison; and store a record of the operation of the associated one or more fixtures, wherein the record comprises an identifier for the associated one or more fixtures, a time of operation, and a date of operation.

3. A system for monitoring a plumbing system having a plurality of fixtures, comprising:

a sensor vibrationally coupled to the plumbing system, the sensor operable to:

detect a vibration produced by the plumbing system; and generate a signal representative of the vibration; and a processor operable to:

receive the signal;

compare the signal to a signal database, the signal database associating each of a plurality of stored signals with operation of one or more of the fixtures;

determine that the associated one or more fixtures have been operated based on the comparison;

store a record of the operation of the associated one or more fixtures; and analyze a collection of stored records to determine usage patterns for the plumbing system.

4. The system of claim 3, wherein the analysis is used to calculate a quantity selected from the group consisting of: a total water usage over a predetermined time period, a maximum water usage, an average water usage, and a flow velocity at a certain point in the plumbing system.

5. A system for monitoring a plumbing system having a plurality of fixtures, comprising:

a sensor vibrationally coupled to the plumbing system, the sensor operable to:

detect a vibration produced by the plumbing system; and generate a signal representative of the vibration;

a processor operable to:

receive the signal;

compare the signal to a signal database, the signal database associating each of a plurality of stored signals with operation of one or more of the fixtures;

determine that the associated one or more fixtures have been operated based on the comparison; and store a record of the operation of the associated one or more fixtures; and wherein the processor uses voice recognition software to assemble the signal database and further uses the voice recognition software to compare the signal to the signal database.

6. A system for monitoring a plumbing system having a plurality of fixtures, comprising:

a plurality of sensors, each sensor vibrationally coupled to a different location in the plumbing system, each sensor operable to:

detect a vibration produced by the plumbing system; and generate a signal representative of the vibration;

a processor operable to:

receive the signal;

compare the signal to a signal database, the signal database associating each of a plurality of stored signals with operation of one or more of the fixtures;

determine that the associated one or more fixtures have been operated based store a record of the operation of the associated one or more fixtures; and the processor is further operable to perform the steps of receiving and comparing for signals received from any of the sensors.

7. A method for monitoring a plumbing system having a plurality of fixtures, comprising:

detecting, by a microphone coupled proximal to a supply line of a plumbing system, a vibration produced by the plumbing system;

generating by the sensor, a signal representative of the vibration;

comparing, by a processor, the signal to a signal database, the signal database associating each of a plurality of stored signals with operation of one or more of the fixtures;

determining that the associated one or more fixtures have been operated based on the comparison; and storing a record of the operation of the associated one or more fixtures.

8. A method for monitoring a plumbing system having a plurality of fixtures, comprising:

detecting, by a sensor, a vibration produced by a plumbing system;

generating, by the sensor, a signal representative of the vibration;

comparing, by a processor, the signal to a signal database, the signal database associating each of a plurality of stored signals with operation of one or more of the fixtures;

determining that the associated one or more fixtures have been operated based on the comparison; and storing a record of the operation of the associated one or more fixtures, wherein the record comprises an identifier for the associated one or more fixtures, a time of operation, and a date of operation.

9. A method for monitoring a plumbing system having a plurality of fixtures, comprising:

detecting, by a sensor, a vibration produced by a plumbing system;

generating, by the sensor, a signal representative of the vibration;

comparing, by a processor, the signal to a signal database, the signal database associating each of a plurality of stored signals with operation of one or more of the fixtures;

determining that the associated one or more fixtures have been operated based on the comparison;

storing a record of the operation of the associated one or more fixtures; and analyzing a collection of stored records to determine usage patterns for the plumbing system.

10. The method of claim 9, wherein the analysis is used to calculate a quantity selected from the group consisting of: a total water usage over a predetermined time period, a maximum water usage, an average water usage, and a flow velocity at a certain point in the plumbing system.

11. A method for monitoring a plumbing system having a plurality of fixtures, comprising:

detecting, by a sensor, a vibration produced by a plumbing system;

generating, by the sensor, a signal representative of the vibration;

comparing, by a processor, the signal to a signal database using voice recognition software, the signal database associating each of a plurality of stored signals with operation of one or more of the fixtures;

determining that the associated one or more fixtures have been operated based on the comparison;

storing a record of the operation of the associated one or more fixtures; and assembling the signal database using voice recognition software.

12. A method for monitoring a plumbing system having a plurality of fixtures, comprising:

detecting by a sensor, a vibration produced by a plumbing system;

generating, by the sensor, a signal representative of the vibration;

comparing by a processor, the signal to a signal database, the signal database associating each of a plurality of stored signals with operation of one or more of the fixtures;

determining that the associated one or more fixtures have been operated based on the comparison;

storing a record of the operation of the associated one or more fixtures;

wherein the sensor is one of a plurality of sensors, wherein each sensor is coupled to a different location in the plumbing system; and wherein the steps of receiving, comparing, determining, and storing are performed for signals received from any of the sensors.

13. A method for monitoring the operation of fixtures of a mechanical system, comprising:

providing a microphone vibrationally coupled to the mechanical system;

detecting, by the microphone, a vibration produced by the mechanical system;

generating, by the microphone, a signal representative of the vibration;

comparing the signal to a signal database using voice recognition software, the signal database associating each of a plurality of stored signals with operation of one or more of the fixtures;

determining that the associated one or more fixtures have been operated based on the comparison;

storing a record of the operation of the associated one or more fixtures; and assembling the signal database using voice recognition software.

14. A method for monitoring the operation of fixtures of a mechanical system, comprising:

providing a sensor vibrationally coupled to a mechanical system selected from a group consisting of: a plumbing system, an automobile engine, a building under construction, and a system for depositing concrete;

detecting, by the sensor, a vibration produced by the mechanical system;

generating, by the sensor, a signal representative of the vibration;

comparing the signal to a signal database, the signal database associating each of a plurality of stored signals with operation of one or more of the fixtures;

determining that the associated one or more fixtures have been operated based on the comparison; and storing a record of the operation of the associated one or more fixtures.

15. The method of claim 14, wherein the steps of comparing, determining and storing are performed by a personal computer.

16. A system for monitoring a plumbing system having a plurality of fixtures, comprising:

means for detecting a vibration produced by a plumbing system;

means for generating a signal representative of the vibration;

means for comparing the signal to a signal database, the signal database associating each of a plurality of stored signals with operation of one or more of the fixtures;

means for determining that the associated one or more fixtures have been operated based on the comparison; and means for storing a record of the operation of the associated one or more fixtures.

17. The system of claim 16, further comprising means for analyzing a collection of stored records to determine usage patterns for the plumbing system.

* * * * *